US006577283B2

(12) United States Patent
Wu et al.

(10) Patent No.: US 6,577,283 B2
(45) Date of Patent: Jun. 10, 2003

(54) DUAL FREQUENCY COAXIAL FEED WITH SUPPRESSED SIDELOBES AND EQUAL BEAMWIDTHS

(75) Inventors: Te-Kao Wu, Rancho Palos Verdes, CA (US); Teh-Kan Tung, Irvine, CA (US); Andrew L. Roberts, Frazier Park, CA (US)

(73) Assignee: Northrop Grumman Corporation, Redondo Beach, CA (US)

( * ) Notice: Subject to any disclaimer, the term of this patent is extended or adjusted under 35 U.S.C. 154(b) by 0 days.

(21) Appl. No.: 09/835,789

(22) Filed: Apr. 16, 2001

(65) Prior Publication Data

US 2002/0149532 A1 Oct. 17, 2002

(51) Int. Cl.[7] ..... H01D 5/12; H01Q 13/02; H01Q 1/42

(52) U.S. Cl. ..... 343/786; 343/789; 343/791

(58) Field of Search ..... 343/791, 786, 343/783, 772, 183, 789, 776, 790, 795, 797, 816

(56) References Cited

U.S. PATENT DOCUMENTS 4,658,258 A * 4/1987 Wilson ..... 343/786
6,163,304 A * 12/2000 Peebles et al. ..... 343/756
6,208,310 B1 * 3/2001 Suleiman et al. ..... 343/772
6,295,035 B1 * 9/2001 Holzheimer ..... 343/792.5
6,323,819 B1 * 11/2001 Ergene ..... 333/134
6,356,241 B1 * 3/2002 Jaeger et al. ..... 343/776

OTHER PUBLICATIONS

C.E. Profera, "Improvement of TE11 Mode Coaxial Waveguide and Horn Radiation Patterns by Incorporation of a Radial Aperture Reactance," IEEE Trans., vol. AP–24, Mar. 1976, pp. 203–206.

J.C. Lee, "A Compact Q/K Band Dual; Frequency Feed Horn," IEEE Trans., vol. AP–32, Oct. 1984, pp. 1108–111.

* cited by examiner

*Primary Examiner*—Don Wong
*Assistant Examiner*—Chuc Tran
(74) *Attorney, Agent, or Firm*—Warn, Burgess & Hoffman, P.C.

(57) ABSTRACT

An antenna feed in a satellite system that provides substantially equal E-plane and H-plane patterns. The feed includes outer and inner conductive walls that are coaxial, and define an outer waveguide therebetween and an inner waveguide within the inner conductive wall. The feed includes a first cylindrical waveguide section, a tapered waveguide section, and a second cylindrical waveguide section at the aperture of the feed. Downlink signals are in signal communication with the first cylindrical waveguide section so that the downlink signals are launched into the outer waveguide and out of the feed. Uplink signals received by the inner waveguide are directed to suitable uplink reception devices. One or both of the outer or inner conductive walls include an array of radially disposed iris pins at the aperture that interact with the uplink and/or downlink signals to provide beam symmetry or equal E-plane and H-plane patterns.

10 Claims, 2 Drawing Sheets

DUAL FREQUENCY COAXIAL FEED WITH SUPPRESSED SIDELOBES AND EQUAL BEAMWIDTHS

BACKGROUND OF THE INVENTION

1. Field of the Invention

This invention relates generally to a dual frequency coaxial feed for an antenna feed horn and, more particularly, to a dual frequency coaxial feed for an antenna feed horn on a satellite that employs an array of conductive iris pins at the aperture of the feed to suppress side-lobes and provide equal E-plane and H-plane patterns.

2. Discussion of the Related Art

Various communications systems, such as certain cellular telephone systems, cable television systems, Internet systems, military communications systems, etc., make use of satellites orbiting the Earth to transfer signals. A satellite uplink communications signal is transmitted to the satellite from one or more ground stations, and is then retransmitted by the satellite to another satellite or to the Earth as a downlink communications signal to cover a desirable reception area depending on the particular use. The uplink and downlink signals are typically transmitted at different frequency bandwidths. For example, the uplink communications signal may be transmitted at 30 GHz and the downlink communications signal may be transmitted at 20 GHz.

The satellite is equipped with an antenna system including a configuration of antenna feeds that receive the uplink signals and transmit the downlink signals to the Earth. Typically, the antenna system includes one or more arrays of feed horns, where each feed horn array includes an antenna reflector for collecting and directing the signals. In order to reduce weight and conserve the satellite real estate, some satellite communications systems use the same antenna system and array of feed horns to receive the uplink signals and transmit the downlink signals. Combining satellite uplink signal reception and downlink signal transmission functions for a particular coverage area using a reflector antenna system requires specialized feed systems capable of supporting dual frequencies and providing dual polarization, and thus requires specialized feed system components. These specialized feed system components include signal orthomode couplers, such as coaxial turnstile junctions, known to those skilled in the art, in combination with each feed horn to provide signal combining and isolation to separate the uplink and downlink signals. Also, the downlink signal, transmitted at higher power (60–100 W) at the downlink bandwidths (18.3 GHz–20.2 GHz), requires low losses and special design for high power and temperature capability feeds.

The uplink and downlink signals are circularly polarized so that the orientation of the reception antenna can be arbitrary relative to the incoming signal. To provide signal discrimination or frequency reuse, one of the signals may be left hand circularly polarized (LHCP) and the other signal may be right hand circularly polarized (RHCP), where the signals rotate in opposite directions. Polarizers are employed in the antenna system to convert the circularly polarized signals to linearly polarized signals suitable for propagation through a waveguide with low signal losses, and vice versa.

One example of an antenna feed for an antenna feed horn used in the antenna systems discussed above is referred in the industry as the Milstar dual band feed. The Milstar dual band feed employs a coaxial design where concentric inner and outer conductive walls define an outer waveguide cavity and an inner waveguide cavity. The downlink signal is transmitted through the outer waveguide cavity and out of a tapered corrugated feed horn, and the uplink signal is received by the same horn and is directed through the inner waveguide cavity. A tapered dielectric is positioned at the aperture of the inner waveguide cavity to provide impedance matching between the feed horn and the inner waveguide cavity, and also launches the uplink signal into the inner waveguide cavity so that it is above the waveguide cut-off frequency. The inner surface of the feed horn is corrugated to provide a symmetrical pattern signal for both the uplink and downlink signals for equal E-plane and H-plane matching. The feed horn is tapered to provide an aperture suitable for illuminating the reflector associated with the antenna system.

The Milstar dual band feed suffers from a number of drawbacks that can be improved upon. For example, the dielectric and the inner waveguide cavity must be carefully aligned and tuned to provide a suitable axial ratio for the uplink signal. Additionally, because the downlink signal is at high power, it tends to cause breakdown in the dielectric, reducing its capability. Thus, the intensity of the downlink signal must be limited in certain applications. Further, the corrugated feed horn is heavy, and adds significant size to the overall size of the feed.

What is needed is a feed for a satellite antenna system that is lightweight, easy to manufacture, and provides equal E-plane and H-plane signals with suppressed side-lobes. It is therefore an object of the present invention to provide such a feed horn.

SUMMARY OF THE INVENTION

In accordance with the teachings of the present invention, an antenna feed for a feed array in a satellite antenna system is disclosed that is lightweight, easy to manufacture, and provides equal E-plane and H-plane signals. The feed includes an outer cylindrical conductor and an inner cylindrical conductor that are coaxial, and define an outer waveguide cavity therebetween and an inner waveguide cavity within the inner conductor. The feed also includes a first cylindrical waveguide section, a tapered waveguide section, and a second cylindrical waveguide section at the aperture of the feed. Downlink waveguides are in signal communication with the first cylindrical waveguide section so that downlink signals are launched into the outer waveguide cavity and out of the feed. Uplink signals received by the inner waveguide cavity are directed to suitable uplink reception devices.

According to the invention, one or both of the outer or inner conductors at the aperture of the second cylindrical waveguide includes an array of radially disposed iris pins that interact with the uplink and/or downlink signals to provide beam symmetry, equal E-plane and H-plane signals, and suppressed side-lobes.

Additional objects, features and advantages of the present invention will become apparent from the following description and appended claims, taken in conjunction with the accompanying drawings.

DETAILED DESCRIPTION OF PREFERRED EMBODIMENTS

The following discussion of the preferred embodiments directed to a feed for an antenna on a satellite is merely exemplary in nature, and is in no way intended to limit the invention or its application to uses.

Figure 1:
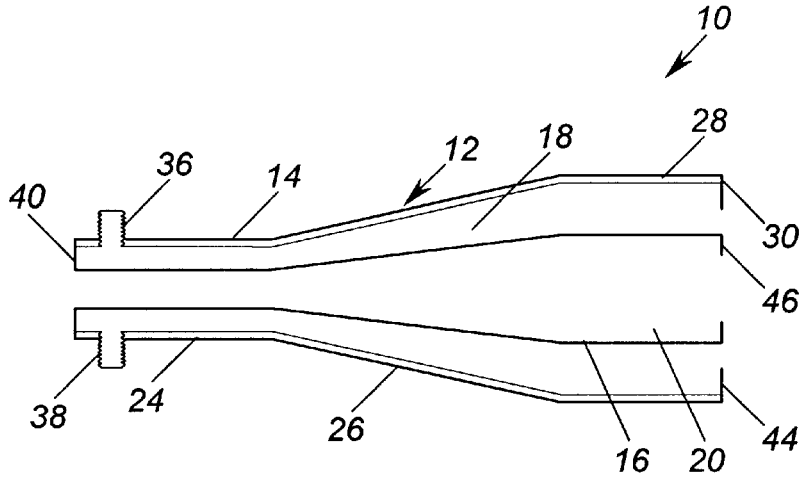
FIG. 1 is a length-wise cross-sectional view of a feed for a satellite antenna system, according to an embodiment of the present invention.

FIG. 1 is a length-wise, cross-sectional view of a feed 10 for a satellite antenna system that receives a satellite uplink signal at a particular frequency band, for example, 28–30 GHz or 44 GHz, and transmits a downlink signal at another frequency band, for example, 18.3–20.3 GHz. As will be appreciated by those skilled in the art, the feed 10 would be part of an array of feeds arranged in a desirable manner depending on the particular application. The antenna system may employ reflectors and the like for collecting and directing the uplink and downlink signals depending on the particular application. By employing feeds of the type discussed herein, separate antenna systems are not needed for the satellite uplink and downlink signals, and therefore valuable space on the satellite can be conserved and the weight of the satellite can be reduced.

The feed 10 includes a feed horn 12 having an outer conductive wall 14 and an inner conductive wall 16 made of a suitable conductive metal. The outer wall 14 and the inner wall 16 are coaxial and define an outer waveguide 18 and an inner waveguide 20. The feed horn 12 includes a first cylindrical section 24, a tapered section 26 that expands the diameter of the feed horn 12 from the first cylindrical section 24, and a second cylindrical section 28 at the output of the feed horn 12. A mouth 30 of the section 28 defines an aperture of the feed 10.

Uplink signals are received by the inner waveguide 20 and propagate into the second cylindrical section 28, the tapered section 26, and the first cylindrical section 24. Suitable reception circuitry and devices (not shown) are provided downstream of the first cylindrical section 24 that convert the circularly polarized uplink signal to a linearly polarized signal suitable for the reception devices within the reception circuitry. Low noise amplifiers, receivers, and other reception devices would be provided to receive the uplink signal, as would be appreciated by those skilled in the art.

A downlink signal to be transmitted by the feed 10 enters the outer waveguide 18 from a 0° coaxial (SMA) input 36 and a 180° coaxial SMA input 38. The coaxial SMA inputs 36 and 38 are connected to a power divider (not shown) that splits the downlink signal into a suitable signal for transmission. A shorting disk 40 is provided over the outer waveguide 18 opposite the mouth 30. This disk and the center pins of coaxial inputs 36 and 38 form an efficient downlink signal launcher for the outer circular waveguide.

In one embodiment for a particular application, the thickness of the outer conductive wall 14 is 0.05 inches. Further, the internal diameter of the first cylindrical section 24 defined by the outer conductive wall 14 is 0.4514 inches and the diameter of the inner waveguide 20 in the cylindrical section 24 is 0.2257 inches. Additionally, the internal dimension of the outer waveguide 18 of the second cylindrical section 28 is 1.048 inches and the diameter of the inner waveguide 20 in the second cylindrical section is 0.524 inches. Further, the first cylindrical section 24 is 2 inches long, the tapered section 26 is 2.1225 inches long, and the second cylindrical section 28 is 2 inches long. These dimensions are by way of a non-limiting example, in that other dimensions for other feeds would be applicable for different applications.

According to the invention, a plurality of outer waveguide iris pins 44 are provided at the mouth 30 of the second cylindrical section 28 so that they extend across the waveguide 18 and transverse to the propagation direction of the downlink signal. The iris pins 44 are spaced apart a predetermined distance and are radially disposed around the entire circumference of the mouth 30. Also, a plurality of iris pins 46 are provided at the mouth 30 of the second cylindrical section 28 so that they extend across the inner waveguide 20 and transverse to the propagation directions of the uplink signal. The iris pins 46 are also radially disposed around the complete circumference of the inner conductor 16. The iris pins 44 and 46 interact with the downlink signals and the uplink signals, respectively, to provide equal E-plane and H-plane signals and a circular polarized (CP) signal with less than 0.5 dB axial ratio. In other words, the iris pins 44 and 46 provide the function of the corrugations in the known Milstar dual band feed. As is apparent, the iris pins 44 do not extend completely across the waveguide 18, and the iris pins 46 do not extend completely halfway across the diameter of the inner waveguide 20. In this embodiment, as shown in FIG. 1, the iris pins 44 and 46 are flat and thin members to provide the benefits as discussed herein.

Figure 2:
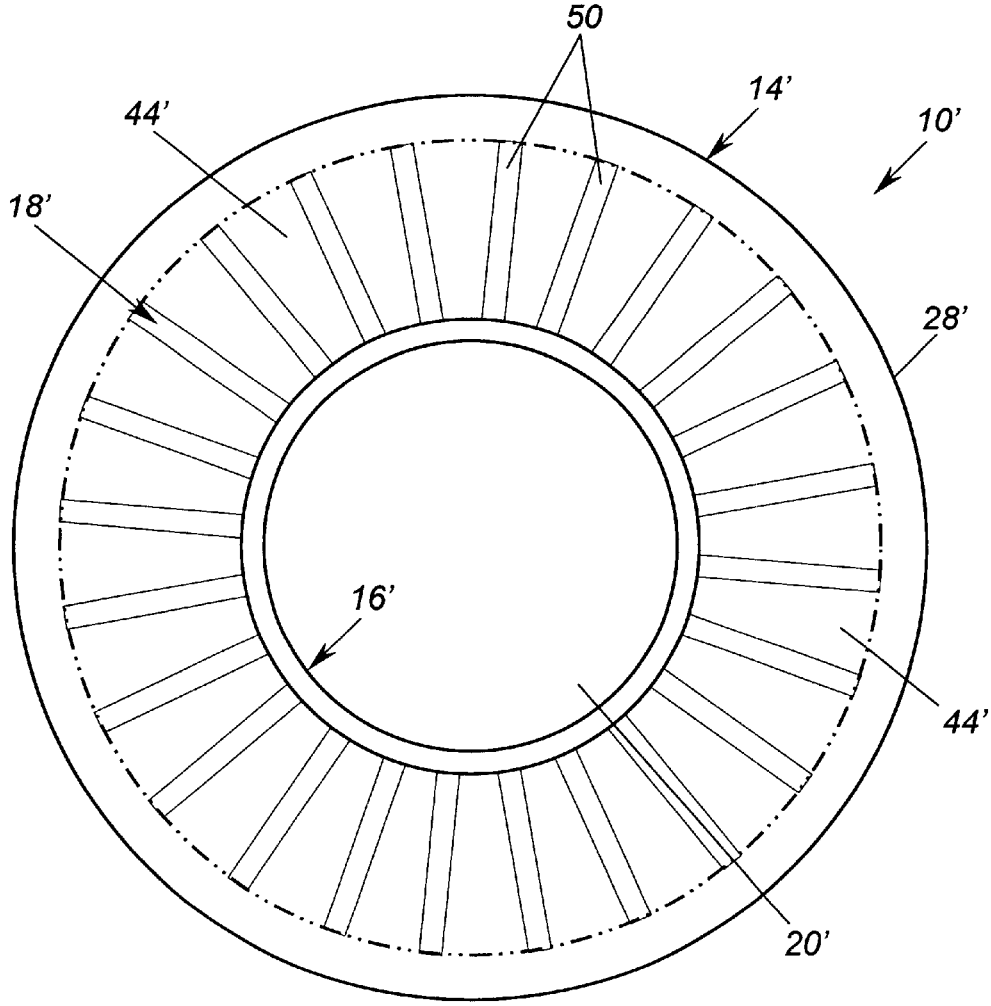
FIG. 2 is a front view of the feed shown in FIG. 1.

FIG. 2 is a front view of a feed 10' that is intended to represent a front view of the feed 10 with the irises 46 removed. In this regard, like components are labeled with the same reference numeral and a prime. As is apparent, the iris pins 44' are trapezoidal-shaped defining a rectangular space 50 between adjacent pins 44. The iris pins 44' extend almost completely across the aperture of the outer waveguide 18, as shown. By providing the iris pins 44' in this configuration, the E-plane portions of the downlink signal interacts with the iris pins 44' so that the field is suppressed and is made equal to the H-plane. Thus, the E-plane and H-plane signals are equalized providing a more circularly polarized signal. Therefore, a more symmetric circularly polarized downlink signal can be provided having a small axial ratio, low side-lobes and low-cross polarization.

In this example, there are twenty-four pins 44", spaced every 15° around the aperture of the outer waveguide 18. Further, the spaces 50 are about 0.032 inches wide and about 1.048 inches in diameter. However, these dimensions are by way of a non-limiting example in that other downlink frequencies and designs may require more or less iris pins, more or less space between the iris pins, etc.

Figure 3:
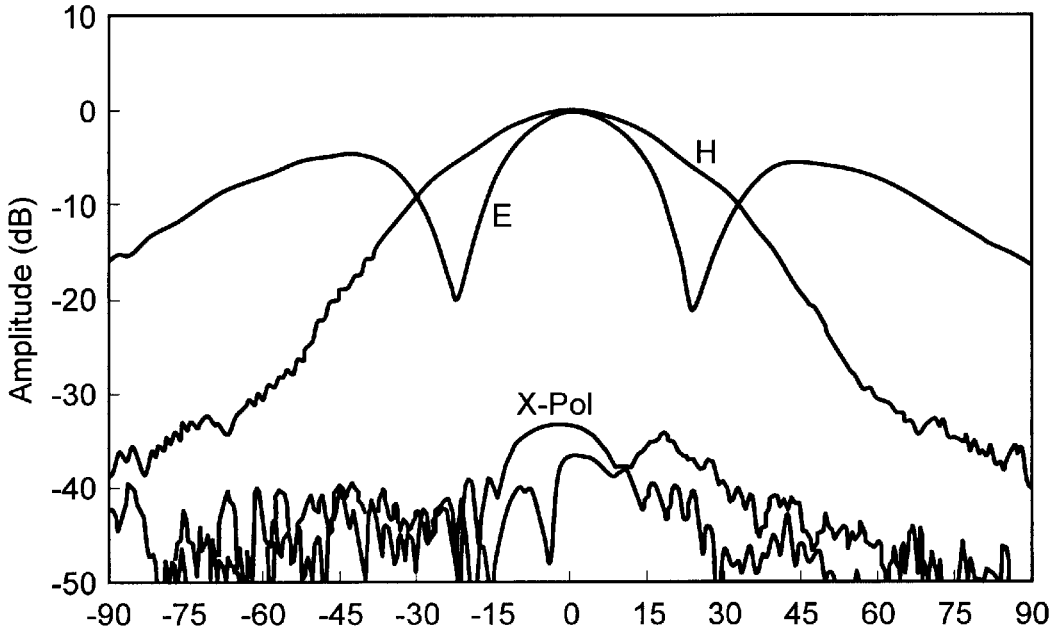
FIG. 3 is a graph with amplitude in dB on the vertical axis and degrees on the horizontal axis showing the radiation pattern for the H-plane and E-plane signals of a conventional dual band coaxial feed configuration.
Figure 4:
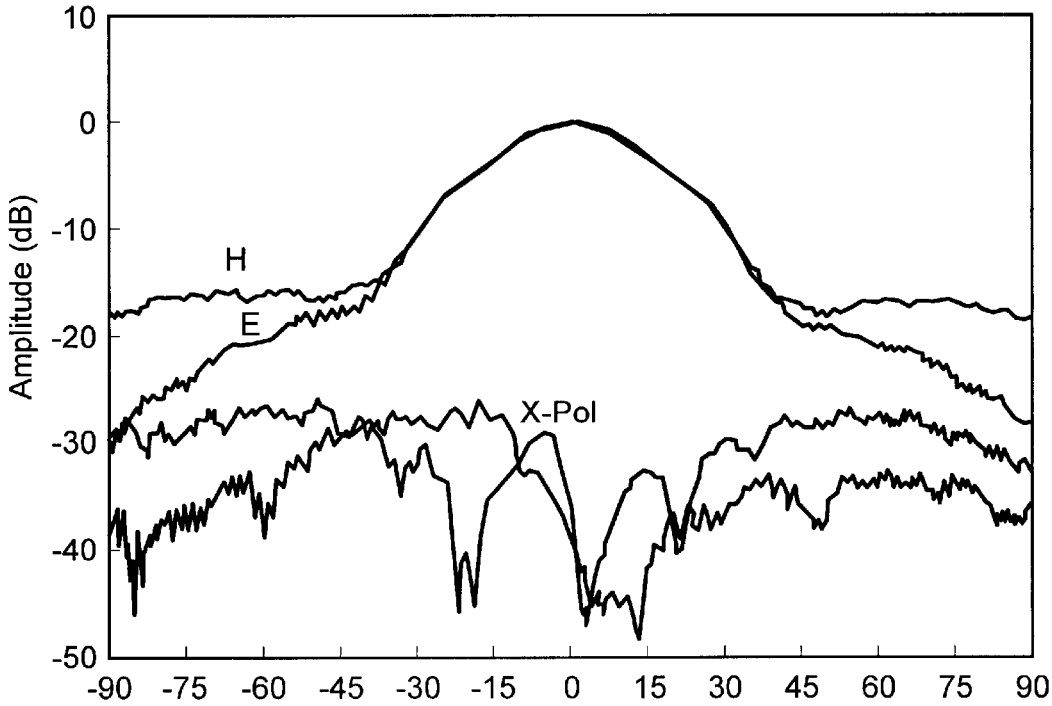
FIG. 4 is a graph with amplitude in dB on the vertical axis and degrees on the horizontal axis showing the radiation pattern for the H-plane and E-plane signals for the feed of the invention.

FIG. 3 is a graph with amplitude in dB on the vertical axis and degrees on the horizontal axis showing the H-plane and E-plane signals for a conventional dual band coaxial feed configuration. As is apparent, the H-plane and E-plane patterns are somewhat unequal, increasing the CP signals axial ratio. FIG. 4 is a graph with amplitude in dB on the vertical axis and degrees on the horizontal axis showing that the H-plane and E-plane patterns for the feeds 10 and 10' are substantially equal over the main lobe of the pattern, and have low side-lobes.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A coaxial feed for an antenna system, said feed transmitting an output signal, said feed comprising:

an outer conductive wall;

an inner conductive wall coaxial with the outer wall and defining an outer waveguide therebetween and an inner waveguide within the inner conductive wall; and a plurality of outer iris pins symmetrically disposed around an opening of the outer waveguide, said iris pins extending across the outer waveguide, said outer iris pins being flat and thin members, said iris pins providing suppressed sidelobes and substantially equal E-plane and H-plane radiation patterns of the signal.

2. The feed according to claim 1 wherein the outer and inner conductive walls are cylindrical.

3. A coaxial feed for an antenna system, said feed transmitting an output signal, said feed comprising:

an outer conductive wall;

an inner conductive wall coaxial with the outer wall and defining an outer waveguide therebetween and an inner waveguide within the inner conductive wall; and a plurality of outer iris pins radially disposed symmetrically around an opening of the outer waveguide so as to define a predetermined space between adjacent pins, said iris pins extending across the outer waveguide, wherein each of the outer iris pins has a trapezoidal shape when viewed in a direction facing the opening so that the predetermined spaces between each pair of adjacent outer iris pins is rectangular, said iris pins providing substantially equal E-plane and H-plane radiation patterns of the signal.

4. A coaxial feed for an antenna system, said feed transmitting an output signal, said feed comprising:

an outer conductive wall;

an inner conductive wall coaxial with the outer wall and defining an outer waveguide therebetween and an inner waveguide within the inner conductive wall; and a plurality of outer iris pins symmetrically disposed around an opening of the outer waveguide, said iris pins extending across the outer waveguide and having a length less than the distance between the outer conductive wall and the inner conductive wall, said outer iris pins being flat and thin members, said iris pins providing suppressed sidelobes and substantially equal E-plane and H-plane radiation patterns of the signal.

5. A coaxial feed for an antenna system, said feed transmitting an output signal, said feed comprising:

an outer conductive wall;

an inner conductive wall coaxial with the outer wall and defining an outer waveguide therebetween and an inner waveguide within the inner conductive wall, said inner and outer conductive walls each having a first cylindrical coaxial section, a tapered section coupled to the first cylindrical coaxial section, and a second cylindrical coaxial section coupled to the tapered section, said outer waveguide having an opening at an output of the second cylindrical section opposite to the first cylindrical section; and a plurality of outer iris pins symmetrically disposed around said outer waveguide opening, said iris pins extending across the outer waveguide, said outer iris pins being flat and thin members, said iris pins providing suppressed sidelobes and substantially equal E-plane and H-plane radiation patterns of the signal.

6. A coaxial feed for an antenna system, said feed transmitting an output signal, said feed comprising:

an outer conductive wall;

an inner conductive wall coaxial with the outer wall and defining an outer waveguide therebetween and an inner waveguide within the inner conductive wall, wherein the inner waveguide is at the center of the feed;

a plurality of outer iris pins symmetrically disposed around an opening of the outer waveguide, said iris pins extending across the outer waveguide, said outer iris pins being flat and thin members, said iris pins providing suppressed sidelobes and substantially equal E-plane and H-plane radiation patterns of the output signal; and a plurality of inner iris pins symmetrically disposed around an opening of the inner waveguide, said inner iris pins being flat and thin members, said inner iris pins providing suppressed sidelobes and equal E-plane and H-plane radiation patterns of an input signal.

7. A coaxial feed for an antenna system on a satellite, said feed transmitting a satellite downlink signal and receiving a satellite uplink signal, said feed comprising:

an outer conductive wall;

an inner conductive wall coaxial with the outer wall and defining an outer waveguide between the inner conductive wall and the outer conductive wall and an inner waveguide within the inner conductive wall, said inner and outer conductive walls having a first cylindrical coaxial section, a tapered section coupled to the first cylindrical coaxial section and a second cylindrical coaxial section coupled to the tapered section, said second coaxial section having an aperture opposite to the first cylindrical section; and a plurality of outer iris pins radially disposed around the aperture of the outer waveguide and extending across the outer waveguide, wherein each of the outer iris pins has a trapezoidal shape when viewed in a direction facing the aperture so as to define rectangular spaces between each pair of adjacent outer iris pins, said iris pins providing equal E-plane and H-plane patterns of the satellite downlink signal.

8. The feed according to claim 7 wherein the iris pins have a length less than the distance between the outer conductive wall and the inner conductive wall.

9. A coaxial feed for an antenna system on a satellite, said feed transmitting a satellite downlink signal and receiving a satellite uplink signal, said feed comprising:

an outer conductive wall;

an inner conductive wall coaxial with the outer wall and defining an outer waveguide between the inner conductive wall and the outer conductive wall and an inner waveguide within the inner conductive wall, wherein the inner waveguide is at the center of the feed, said inner and outer conductive walls having a first cylindrical coaxial section, a tapered section coupled to the first cylindrical coaxial section and a second cylindrical coaxial section coupled to the tapered section, said section coaxial section having an aperture opposite to the first cylindrical section;

a plurality of outer iris pins radially disposed around the aperture of the outer waveguide and extending across the outer waveguide, said outer iris pins being flat and thin members, said outer iris pins providing suppressed sidelobes and equal E-plane and H-plane patterns of the satellite downlink signal; and a plurality of inner iris pins symmetrically disposed around the aperture of the inner waveguide, said inner iris pins being flat and thin members, said inner iris pins providing suppressed sidelobes and equal E-plane and H-plane patterns of an input signal.

10. The feed according to claim 9 wherein the plurality of inner iris pins have a length less than half the diameter of the inner waveguide.

* * * * *